343-700 MS AU 256 EX
5/9/78 OR 4,089,003

United States Patent [19]

Conroy

[11] 4,089,003

[45] May 9, 1978

[54] MULTIFREQUENCY MICROSTRIP ANTENNA

[75] Inventor: Peter J. Conroy, Scottsdale, Ariz.

[73] Assignee: Motorola, Inc., Schaumburg, Ill.

[21] Appl. No.: 766,099

[22] Filed: Feb. 7, 1977

[51] Int. Cl.[2] ..... H01Q 13/10; H01Q 1/28

[52] U.S. Cl. ..... 343/700 MS; 343/846; 343/853

[58] Field of Search ..... 343/829, 830, 846, 847, 343/769, 767, 700 MS, 853

[56] References Cited

U.S. PATENT DOCUMENTS

| | | | |
|---|---|---|---|
| 3,541,557 | 11/1970 | Miley | 343/767 |
| 3,739,386 | 6/1973 | Jones, Jr. | 343/769 |
| 3,803,623 | 4/1974 | Charlot, Jr. | 343/769 |

*Primary Examiner*—Alfred E. Smith
*Assistant Examiner*—David K. Moore
*Attorney, Agent, or Firm*—Eugene A. Parsons

[57] ABSTRACT

Three spaced apart electrically conducting discs coaxially mounted with dielectric material therebetween, one outside disc forming a ground plane and the center disc being driven by a lead through the ground plane to form a first microstrip antenna resonant at a first frequency, and the center disc forming a ground plane for the other outside disc which if fed by a lead extending through both of the other discs on a plane of zero electrical field for the second plate and along a radius orthogonal with a radius through the first lead, to form a second microstrip antenna resonant at a second frequency.

6 Claims, 3 Drawing Figures

MULTIFREQUENCY MICROSTRIP ANTENNA

BACKGROUND OF THE INVENTION

1. Field of the Invention

Multifrequency antennas are desirable in a variety of electronic circuitry, for communications and the like. In many instances it may be desirable to receive signals of a first frequency on one antenna and transmit signals of a second frequency on a second antenna and, because of size and weight considerations it is desirable to provide a single antenna which can perform these function. Many other applications may also arise, such as where equipment is constructed to transmit and/or receive on a plurality of different frequencies.

2. Description of the Prior Art

In the prior art, typically dual frequency antennas are extremely complicated or large and cumbersome, so that in either case they are extremly expensive to manufacture and, generally, much too large for many uses. An example of the former type of dual frequency antenna is disclosed in U.S. Pat. No. 2,479,227, entitled "Dual Frequency Antenna", issued to E. N. Gilbert, on Aug. 16, 1949. An example of the latter type of dual frequency antenna is disclosed in U.S. Pat. No. 3,971,032, entitled "Dual Frequency Microstrip Antenna Structure", issued to Robert E. Munson, et al on July 20, 1976.

With the advent of microstrip antennas, such as that described in U.S. Pat. No. 3,803,623, entitled "Microstrip Antenna", and issued to Lincoln H. Charlot, Jr., on Apr. 9, 1974, simple, low profile antennas became available. A comprehensive discussion and analysis of microstrip antennas has been published in the periodical "IEEE Transactions on Antennas and Propagations", Jan. 1975, pages 90–93, entitled Microstrip Antennas, written by John Q. Howell. While the microstrip antennas are simple and inexpensive to construct, any multifrequency antennas utilizing this technology are either severely limited in form or complicated to construct.

SUMMARY OF THE INVENTION

The present invention pertains to a multifrequency microstrip antenna including at least three plates of electrically conducting material mounted generally coaxially in spaced apart relation with dielectric material therebetween so that a first outside plate forms a ground plane with the adjacent inner plate forming the active element and fed by a lead extending through the ground plane and the inner plate also forming a ground plane in conjunction with the remaining outer plate which is fed by a lead extending through the other two plates on a plane of zero electrical field for the inner plate, with the first outer plate and the center plate forming a first microstrip antenna resonant at a first frequency and the inner plate and the second outer plate forming a second microstrip antenna resonant at a second frequency.

It is an object of the present invention to provide an improved multifrequency microstrip antenna.

It is a further object of the present invention to provide an improved multifrequency microstrip antenna which is substantially smaller, simpler to construct and less expensive than prior art multifrequency antennas.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
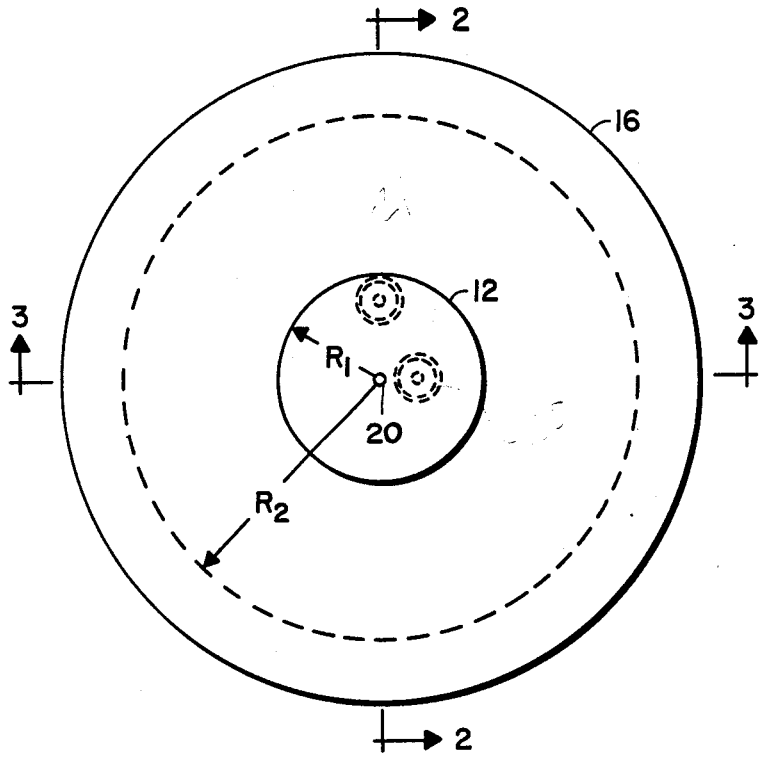
FIG. 1 is a view in top plan of a multifrequency microstrip antenna embodying the present invention.
Figure 2:
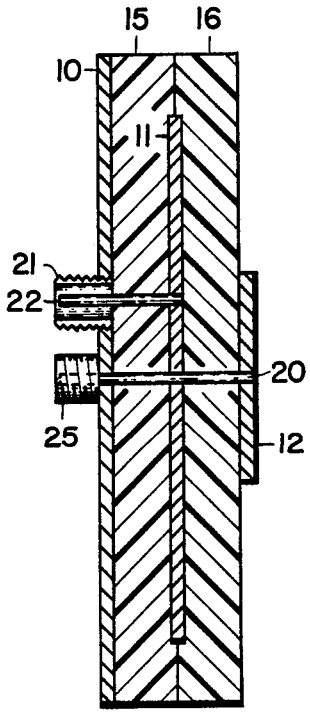
FIG. 2 is a sectional view as seen from the lines 2—2 in FIG. 1.
Figure 3:
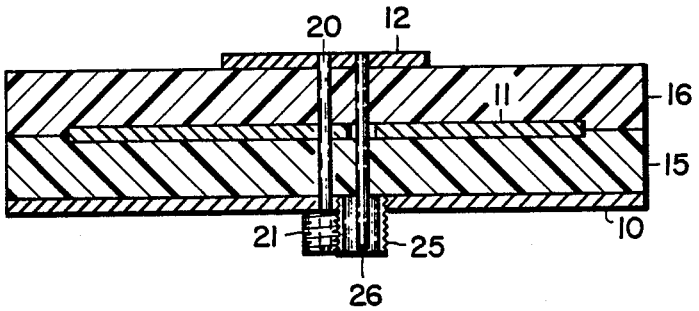
FIG. 3 is a sectional view as seen from the lines 3—3 in FIG. 1.

Referring to the Figures, a multifrequency antenna is illustrated. In this embodiment the multifrequency antenna is a dual frequency antenna, but it should be understood that additional antennas or frequencies can be incorporated therein by following the principles taught in this disclosure. The antenna illustrated includes three electrically conductive plates or discs 10, 11 and 12. The three discs are mounted generally coaxially in spaced apart relation with a first layer of dielectric material 15 between the plates 10 and 11 and a second layer of dielectric material 16 between the plates 11 and 12. It should be understood that the dielectric material 15 and 16 might be the same or different materials might be utilized for purposes which will become apparent presently. Generally, the discs or plates 10, 11 and 12 are a thin conductive material, such as copper or the like which is deposited on the dielectric layers 15 and 16 as, for example, by techniques well known to those manufacturing printed circuit boards and the like. The techniques for manufacturing multilayer printed circuit boards are particularly suited for the construction of this multilayer antenna.

The disc or plate 10 extends the entire diameter of the antenna and operates as a ground plane. Each of the other discs 11 and 12 are connected to the disc 10 by means of a center connecter 20. Because the centers of the discs 10, 11 and 12 are connected together, or shorted, the impedence at the center is zero and increases along the radii of the discs to a maximum at the outer peripheries thereof. Thus, by selecting a particular point along a radius, any desired impedence for the antenna can be obtained.

A connector 21 is affixed to the rear side of the disc 10 so that an outer or threaded portion, which is generally ground, is connected to the disc 10, and a center lead 22 passes through the disc 10 (without connection thereto) and is connected to the center disc 11. The center disc 11 is fed or driven by means of the lead 22 and serves as an active element of a microstrip antenna with the disc 10 forming the ground plane thereof. As previously mentioned, the impedence of this antenna is determined by the distance of the lead 22 from the center connecting lead 20 as measured along a radius of the antenna. The resonant frequency of this antenna is determined by the radius of the disc 11 and the particular type of dielectric material in the layer 15. The resonant frequency, radius of the disc 11 and type of dielectric material in the layer 15 are related according to the following formula $$R_2 = \frac{\lambda_1(1.84)}{2\pi\sqrt{e_{r_1}}}$$

where $\lambda_1$ is the wavelength of the resonant frequency and $e_{r_1}$ is the dielectric constant of the dielectric material in the layer 15.

A second connector, generally designated 25, has an outer or threaded portion connected to the rear of the plate 10 and a center lead 26 extending through the plate 10 and through the plate 11 to connect with the plate 12. The plate 12 is the active element of a second antenna with the plate 11 serving as the ground plane. It has been found, by experimentation, that a plane of zero electrical field for the active element 11 extends along a diameter of the antenna orthoganal to a radius through the feedpoint (lead 22) for the active element 11. If the lead 26 feeding the active element 12 is positioned in the plane of zero electrical field for the plate 11, the lead 26 has no effect on the field developed by the active element 11. Thus, by positioning the leads 22 and 26 on orthoganal radii of the antenna the leads only effect the plates to which they are connected. Therefore, plates 10 and 11 form a first microstrip antenna resonant at a first frequency, with plate 10 being the ground plane and plate 11 being the active element, and plates 11 and 12 form a second microstrip antenna resonant at a second frequency with plate 11 forming the ground plane and plate 12 being the active element. The second resonant frequency and the the radius of the plate 12 are interrelated in accordance with the following formula $$R_3 = \frac{\lambda_2(1.841)}{2\pi\sqrt{e_{r_2}}}$$

where $\lambda_2$ is the wavelength of the second resonant frequency and $e_{r_2}$ is the dielectric constant of the dielectric material in layer 16. Again, the impedence of the second antenna is determined by the position of the lead 26 along the radius of the antenna.

Thus, an improved multifrequency microstrip antenna is disclosed which is relatively simple to construct and is greatly reduced in size and weight. Further, the antenna illustrated forms a generally symmetrical, or teardrop, pattern which is highly desirable in many applications. Also, additional antennas or resonant frequencies can be added to the disclosed antenna by simply adding additional discs separated by additional layers of dielectric material with the feedlines situated so that they lie in a plane of zero electrical field when they pass through other active plates.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. Multifrequency microstrip antenna means comprising:

(a) at least three generally circular plates of electrically conducting material mounted generally coaxially in spaced apart relationship with dielectric material therebetween;

(b) a first plate of said three plates being electrically connected to a reference potential and forming a ground plane for a first microstrip antenna resonant at a first frequency;

(c) a second plate of said three plates positioned adjacent said first plate for serving as an antenna element and forming the first microstrip antenna in conjuction with said first plate, said second plate further forming a ground plane for a second microstrip antenna resonant at a second frequency;

(d) a third plate of said three plates positioned adjacent said second plate for serving as an antenna element and forming the second microstrip antenna in conjunction with said second plate; and (e) means connected to said second plate for feeding said first microwave antenna and means connected to said third plate for feeding said second microwave antenna, and each of said second and third plates being electrically connected to said first plate at approximately the centers thereof.

2. Multifrequency microstrip antenna means as claimed in claim 1 wherein each of the second and third plates is fed by the connected means through the first plate.

3. Multifrequency microstrip antenna means as claimed in claim 2 wherein the connected means includes a first lead through the first plate connected to the second plate and a second lead through the first and second plates connected to the third plate, said second lead extending through the second plate on a plane of a zero electrical field for the second plate.

4. Multifrequency microstrip antenna means as claimed in claim 3 wherein the points at which the first and second leads pass through the first plate lie along orthogonal radii of said first plate.

5. Multifrequency microstrip antenna means as claimed in claim 4 wherein the distance from the center of the points at which the first and second leads pass through the first plate is selected for a predetermined impedence.

6. Multifrequency microstrip antenna means as claimed in claim 5 wherein the radius of the second and third plates is determined by the formula $$R_2 = \frac{\lambda_1(1.841)}{2\pi\sqrt{e_{r_1}}}$$

$$R_3 = \frac{\lambda_2(1.841)}{2\pi\sqrt{e_{r_2}}}$$

respectively, where $\lambda_1$ and $\lambda_2$ are the wavelengths of the first and second resonant frequencies, respectively, $e_{r_1}$ and $e_{r_2}$ are the dielectric constants of the dielectric material between the first and second plates and between the second and third plates, respectively.

* * * * *